United States Patent [19]

Müller

[11] 3,940,753

[45] Feb. 24, 1976

[54] DETECTION OF PRESENCE OR ABSENCE OF FLAMES

[75] Inventor: Peter Müller, Oetwil a. See, Switzerland

[73] Assignee: Cerberus AG, Mannedorf, Switzerland

[22] Filed: Sept. 13, 1974

[21] Appl. No.: 505,627

[30] Foreign Application Priority Data

Sept. 25, 1973 Switzerland ..... 13722/73

[52] U.S. Cl. ..... 340/227 R; 340/228.2

[51] Int. Cl.[2] ..... G08B 21/00

[58] Field of Search ..... 340/227 R, 228.2

[56] References Cited

UNITED STATES PATENTS

| | | | |
|---|---|---|---|
| 3,609,364 | 9/1971 | Paine | 340/228.2 |
| 3,665,440 | 5/1972 | McMenamin | 340/228.2 |
| 3,689,773 | 9/1972 | Wheeler | 340/228.2 |
| 3,716,717 | 2/1973 | Scheidweiler | 340/228.2 |
| 3,824,391 | 7/1974 | Noltingk et al. | 340/228.2 |

*Primary Examiner*—Marshall M. Curtis

*Attorney, Agent, or Firm*—Flynn and Frishauf

[57] ABSTRACT

At least two photoelectric sensors, sensitive to different spectral ranges of incident light, provide two sensed output signals; the relationship of the a-c components of the sensed output signals is evaluated, and it is determined if these a-c components fall within predetermined low frequency ranges, for example, 2 to 50 Hz, preferably 5 to 25 Hz; if so, a "flame present" signal is provided, for example to give a fire alarm, or to indicate that a burner is operating. Preferably, the relationship of the signals is such that a different signal is provided between one of the sensed signals and a fraction of the other, and conversely, and the sensitivity of the sensors is adjusted to have the same output signals at a predetermined color temperature, for example about 1,400° K. Illumination signals incident on the sensors due to other sources than flames then are reliably eliminated while still providing the "flame present" signal upon coincidence of the appropriate difference signals, which coincidence preferably is determined by analyzing the phase relationships of the resulting difference signals in a phase comparator.

20 Claims, 1 Drawing Figure

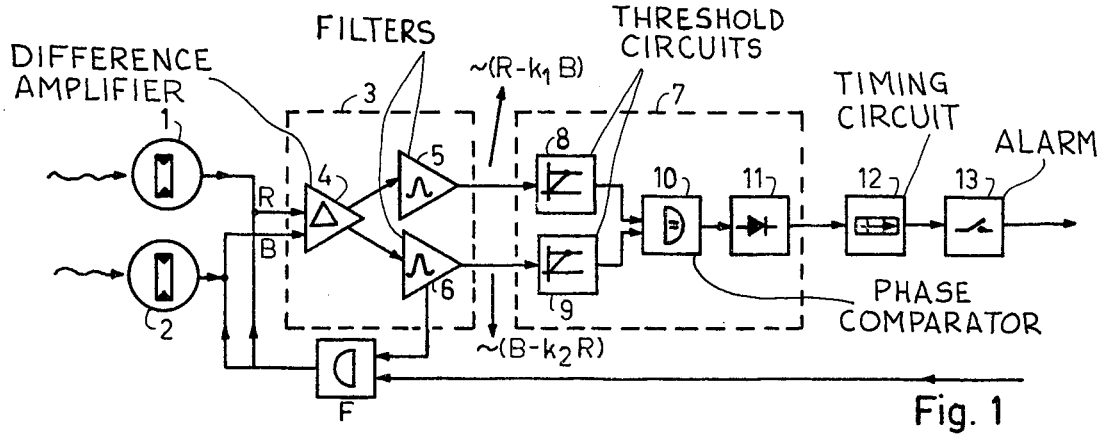
Fig. 1
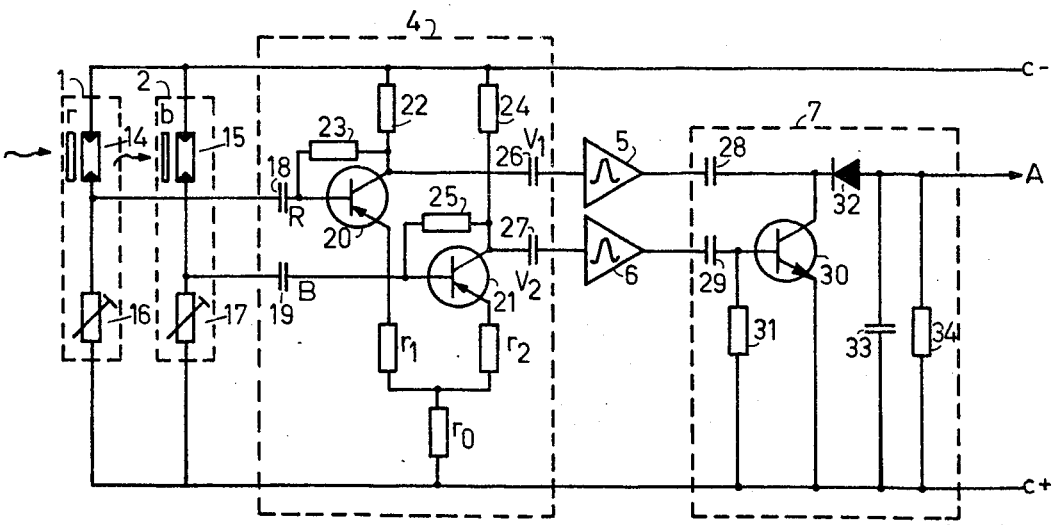
Fig. 2
Fig. 3
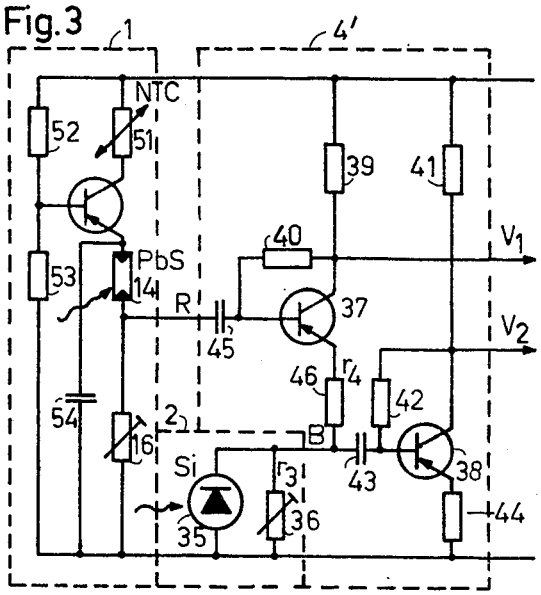
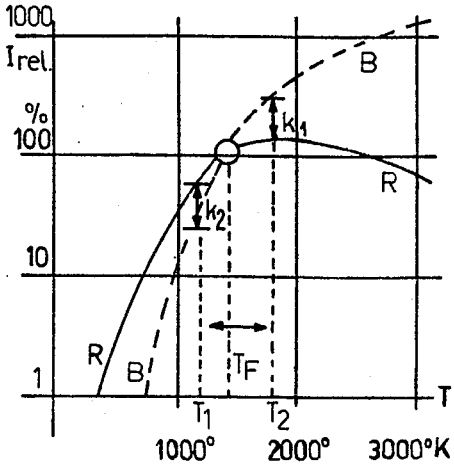
Fig. 4

DETECTION OF PRESENCE OR ABSENCE OF FLAMES

CROSS REFERENCE TO RELATED PATENTS

U.S. Pat. No. 3,716,717, Scheidweiler;
U.S. Pat. No. 3,739,365, Müller;
U.S. Pat. No. 3,742,474, Müller,
assigned to the assignee of the present invention.

The present invention relates to determining the presence or absence of a flame in which visible and/or invisible radiation from the flame is applied to at least two photoelectric sensors having different spectral sensitivity, and the output signals from the sensors are then evaluated. The flame may be detected in order to provide a fire alarm signal or, for example, to supervise operation of burners, furnaces and the like.

Flame detectors in which radiation from the flames is sensed have been proposed, utilizing radiation derived from the flames in the visible light range, infrared (IR) range, or ultraviolet (UV) range. Known flame detectors, to provide outputs representative of presence of a flame, and operating purely within the above referred to light ranges, frequently are not reliable, since signals are derived not only from radiation due to flames, but also caused by extraneous radiation, such as daylight, artificial light sources, radiant heaters providing IR radiation, and the like, although no real flame — to be sensed — is present. It is therefore necessary to provide characteristic differences which distinguish flame radiation from extraneous disturbance radiation when evaluating the signals in order to prevent erroneous signals and malfunction.

In one flame detector, which has been proposed, different spectral composition of radiation from flames is used in order to distinguish radiation from flames and disturbing or interfering radiation. Two photoelectric sensors with different spectral sensitivity are exposed to radiation from the flame; for example, one photoelectric sensor is sensitive to blue light, and one is sensitive to red light. The photo cells may be serially connected. At the junction point between the two photo cells, a d-c signal will occur which depends on the spectral composition or the color of the light radiation to which the sensors are exposed. Such a flame detector, while functioning properly under most conditions may, however, react to interfering radiation which by chance has the same, or similar spectral composition as radiation from a flame.

It has also been proposed to distinguish between signals from flames and disturbing signals by utilizing variation of radiation from a flame. Flames do not radiate constantly, that is, with uniform intensity, but rather fire, or flames are subject to flicker, particularly within a certain frequency range. The signal from a photo sensor is applied to a band pass filter which passes signals only in a limited frequency range which is characteristic for flame flicker. Such apparatus unfortunately also can be triggered by disturbing radiation of varying intensity, for example light reflected from water surfaces, sunlight interrupted by leaves and branches moving in the wind, or by fluorescent lights which are about to burn out and flicker off and on.

The two above referred to characteristics of flames can be combined, and in a further previously proposed flame detector, the two characteristics are both evaluated. First, a difference signal from two photoelectric devices of different spectral sensitivity is formed, and later the a-c component within a specific flicker frequency is derived. The sensitivity or the amplification of the two photoelectric devices is so set that the difference signal is zero for certain expected disturbing radiations of known spectral composition. Such an apparatus may eliminate, however, only a single interfering radiation, and can be set only to eliminate such a single interference, for example sunlight or daylight; other interfering radiation of different spectral composition, for example artificial light sources, fluorescent lamps and the like, may still trigger an erroneous "flame present" signal.

It is an object of the present invention to improve the detection of flames by eliminating disturbances to a degree heretofore not possible, which is reliable and does not lead to generating erroneous "flame present" signals due to disturbing radiation.

Subject matter of the present invention

Briefly, the relationship of the a-c components of output signals from sensors of different spectral sensitivity is evaluated to determine if the relationship of the a-c components falls within a predetermined frequency range between two limiting values; a "flame present" signal is generated only if the relationship is between these two values. Preferably, one of the sensors is sensitive to blue radiation and the other to red radiation, the sensitivity of the sensors being so adjusted that at one specific color temperature the output of the sensors is equal. A suitable color temperature is, for example, in the order of about 1,400° K. The signal is evaluated by forming a difference signal between the red signal and a portion of the blue, and the blue signal and a portion of the red, and then analyzing the relative phases of the output signals within a limited low-frequency range, for example about 2 to 50 Hz, preferably about 5 to 25 Hz.

In accordance with a feature of the invention, the system to evaluate the signals from the sensors includes at least one differentiating amplifier to which the signals are applied, and a phase comparator which has the two weighted difference signals applied thereto and which compares the phase differences between the signals and provides a "flame present" signal when the first and second difference signals, derived as above, have the same phase position.

The invention will be described by way of example with reference to the accompanying drawings, wherein:

FIG. 1 is a general schematic block circuit diagram of the system of the present invention;

FIG. 2 is a detailed circuit diagram of the system of FIG. 1;

FIG. 3 is a fragmentary detailed diagram of a different embodiment of the sensing and difference forming circuit; and FIG. 4 is a graph of output current from the respective sensors (ordinate) with respect to color temperatures in °K (abscissa).

Two photoelectric sensors 1, 2 (FIG. 1) are exposed to light radiation from the flame. The sensor 1 is primarily sensitive to red radiation, and the sensor 2 is primarily sensitive to blue radiation, and the output signals are red (R) and blue (B), respectively. The spectral sensitivity, therefore, of the two sensors is different. Various types of photoelectric sensors may be used; the sensor is shown only schematically and may include, if necessary, further circuit elements, for example amplifiers and the like, to convert the incident radiation into an electrical signal. The different spectral sensitivity can be obtained either by using different types of photoelectric sensors, or by placing suitable filters before the sensors. The spectral sensitivity of the two photoelectric sensors may be selected to be in any desired range of electromagnetic radiation; a preferred range, however, is visible light and infrared radiation, sensitivity to red and blue being only an example. In the example of FIG. 1, the sensor 2 is sensitive to blue light, the sensor 1 is sensitive to red light. The sensors may, however, also be sensitive for example to different wave lengths, or ranges of wave lengths within the infrared band.

The two output signals R and B from the photoelectric cells are applied to two inputs of a difference amplifier 3. The difference amplifier 3 is so arranged that at the outputs thereof signals appear which are proportional to (R–$k_1$(B–*and* (*B*-$k_2$R), in which $k_1$ and $k_2$ are constants. The amplifier is so designed that it passes only the a-c component within a predetermined low-frequency range of the signals; this low-frequency range is so selected that it is characteristic for the flicker of flames and is, for example, in the order of from 2 to 50 Hz. If better selectivity is desired, then the range may be narrowed to be between 5 to 25 Hz. The difference amplifier 3 preferably includes a difference amplifier unit 4 which has two outputs, connected to filters 5, 6, passing the desired frequency band only; alternatively, instead of filters, frequency selective amplifiers may be used.

The two output signals from the difference amplifier 3 are applied to the two inputs of a phase comparator 7. The phase comparator 7 first includes threshold detectors 8, 9, one each connected to an input of the phase comparator. The threshold detectors 8, 9 pass a signal only if the input signal exceeds a predetermined threshold level. The threshold level can be selected to be low, that is, just slightly greater than 0, or null, so that even low radiation from small flames can still be detected. The two signals are then applied to the inputs of a gate 10 which provides an output signal only if the two input signals applied have the same phase position, that is, are either instantaneously both positive, or both negative; no signal is derived from gate 10 when the two signals are oppositely phased. The output signal from gate 10 is applied over a rectifier 11 to form an average value to an output which, if the system is to be a fire detector, provides an alarm signal.

The output itself preferably includes a timing circuit 12 between it and the alarm circuit itself; the timing circuit provides an output signal to the actual alarm system, schematically shown as a switch 13 only if the input signal persists for a predetermined period of time, in order to prevent false alarms due to short interferences or disturbances, for example when room illumination is first switched ON or OFF.

The output signal can trigger an external alarm if the flame detector is utilized in a fire alarm system. The output signal may, however, also be utilized to signal the presence of a desired flame, that is, to supervise presence of a flame from a burner, for example.

A feedback circuit F is provided to test operability of the system by applying a test signal from a central line to one input of the gate F.

One embodiment of a detailed circuit is seen in FIG. 2: The two photoelectric devices 1, 2 are connected in parallel. Each includes a photo resistor 14, 15 and a series connected trimmer resistor 16, 17 and, further, each has an optical filter *r, b*, filtering radiation from flames; the filters have different spectral pass band ranges, for example preferentially passing red and blue light, respectively.

The output signals which arise at the junction point between the photo resistor and the fixed trimmer resistor of the two photoelectric sensors 1, 2, are applied over capacitors 18, 19 to the difference circuit 4. The difference circuit 4 includes, for each of the signals, an amplifier having transistors 20, 21 and associated collector and base resistors 22, 23, 24, 25.

The transistors are so connected that each one has a separate emitter resistor $r_1$ and $r_2$, respectively, which are commonly connected to a common resistor $r_0$. By arranging the circuit such that the transistors have both separate and common emitter resistors, signals $V_1$ and $V_2$ will be obtained at the outputs of the difference circuit 4 which are defined by relationships (1) and (2). In those relationships, the factors $k_1$ and $k_2$ are derived from the resistors $r_0$, $r_1$ and $r_2$ as set forth in relationships (3) and (4). The proportionality factors $g_1$ and $g_2$ are derived from the amplification data and from the operating characteristics of the transistors 20, 21, respectively, as well as from the value of the resistors 22, 23 for transistor 20 and 24, 25 for transistor 21, as well as of the relative values of the resistances $r_1$, $r_2$ and $r_0$.

The output signals $V_1$ and $V_2$ of the difference circuit 4 are applied over coupling capacitors 26, 27 to band pass filters or band pass amplifiers 5, 6 which, in turn,

LISTING OF FORMULAE FORMING PART OF THE SPECIFICATION AND CLAIMS $$V_1 = g_1 (R - k_1 B) \quad (1)$$
$$V_2 = g_2 (B - k_2 R) \quad (2)$$

$$k_1 = \frac{r_o}{r_0 + r_2} < 1 \quad (3)$$

0

$$k_2 = \frac{r_0}{r_0 + r_1} < 1 \quad (4)$$

$$k_1 = 1 \quad (5)$$
$$k_2 = - r_3/r_4 \quad (6)$$

provide their output signals to the input capacitors 28, 29 of the phase comparator 7.

The phase comparator 7 includes a transistor 30, having its base coupled by capacitor 29 to the output signal from band pass filter or band pass amplifier 6. The transistor 30 further has a base resistance 31, and its collector is connected to the junction between capacitor 28 and a diode 32. The anode of the diode 32 is connected to one terminal of a capacitor 33 with a parallel connected resistor 34.

Operation of phase comparator: If the signals $V_1$ and $V_2$ are in phase, then the circuit operates like the well known voltage doubler circuit, in which, however, the transistor 30 replaces a further diode, similar to the diode 32. When the a-c voltage across capacitor 29 is in phase with the a-c voltage across capacitor 28, transistor 30 is alternately conductive and blocked, in phase, that is, in rhythm or in synchronism with the signal across capacitor 28, so that capacitor 33 will have twice the input voltage of capacitor 28 built up thereacross. If, however, the two input signals are oppositely phased, transistor 30 is opened in the wrong rhythm, and will block at the wrong time to permit capacitor 33 to charge; no output voltage can build up across capacitor 33 or, respectively, the capacitor discharges immediately over resistor 34. Simultaneously, the circuit provides for rectification, so that the output terminal A of the phase comparator 7 will have a voltage built up thereacross which is a direct voltage, but only if the two input signals are in synchronous phase; no voltage will build up when the phase position is different.

The embodiment of FIG. 3 utilizes a first photoelectric device 1 which, again, includes a photosensitive resistor 14 and a trimmer resistor 16 in series therewith. The second photoelectric device 2, however, includes a photo diode 35 with a parallel connected load resistor 36. Both photoelectric sensors are so selected that they have, due to their characteristics, different spectral sensitivity. Additional filters may thereby be avoided. In one practical example, the sensor 14 is a lead sulfide resistor with a germanium filter; the photo diode 35 is a silicon diode of the solar cell type. Both the sensor 14 as well as the silicon diode are located behind a common infrared filter glass. The maximum sensitivity of the sensor unit 14 is at about 2.2 microns and that of the silicon diode is at about 0.9 microns.

The difference circuit 4' has two input resistors 43, 45 and two transistors 37, 38 having respective collector and base resistors 39, 40; 41, 42. The emitter resistor 44 of transistor 38 is directly connected to one terminal of the supply line; the emitter resistor 46 of the transistor 37 is connected, however, to the output of the other photoelectric device 2, that is, to the silicon diode solar cell 35, with parallel connected resistor 36. This circuit provides, again, the signals $V_1$ and $V_2$ of the relationships (1) and (2) above, in dependence on the input signals R and B. The factors $k_1$ and $k_2$ will, however, be as in relationships (5) and (6).

A negative temperature coefficient (NTC) resistor 51 and a transistor 50 can be connected in series with the lead sulfide cell 14. The base of the transistor 50 is connected to the tap or junction point of the voltage divider formed by resistors 52, 53. Change in the dark current and the photosensitivity of the PbS resistor 14 due to temperature changes is thereby compensated. A capacitor 54 is connected in parallel to the photo resistor 14 and the balancing or trimmer resistor 16 to provide for smoothing of the voltage on the photo resistor 14.

The present invention is not restricted to the examples shown, nor to the circuits described; other circuits may be used, which provide output signals of similar characteristics. Various different types of circuit elements, components and sub-circuit assemblies may be used which provide similar outputs with similar input signals.

Operation of the system, with reference to FIG. 4: Curve R — full line — illustrates the relative output signals of a detector which operates in a range of relatively high wave length, for example in the high infrared range, in dependence on absolute temperature T of a radiation source. The broken-line curve B shows relative output current for a temperature sensor sensitive to relatively shorter wave length. The trimmer resistors 16, 17, and 36, respectively, of the photoelectric sensors 1 and 2 are so adjusted that the output signals R and B are equal at a given temperature. The given color temperature selected is the average temperature $T_F$ which is ordinarily expected in a flame; a typical temperature is in the order to about 1,400° K. This is a suitable color temperature when the system is to be used for fire detection.

The resistance values of the difference amplifier are then so selected that the factors $k_1$ and $k_2$ are between 0 and 1; a suitable value, for example, is about ⅓. If the red/blue signal relationship, after the sensors are adjusted to an average temperature, becomes less than 1, that is, if the source of radiation has a higher color temperature, then the output signals from the two amplifiers will be oppositely phased if the red/blue ratio becomes smaller than the factor $k_1$. A source of radiation of lower color temperature, that is, having a red/blue relationship greater than 1, provides oppositely phased signals when the red/blue relationship becomes greater than $1/k_2$. At an assumed value of $k_1 = ⅓$ and $k_2 = ⅓$, and an adjustment for an average temperature of 1,400° K, a temperature range of the radiation source of about 1,150° K to 1,700° K will still provide output signals in which the two signals are still in phase, that is, a range in which an alarm signal will be obtained. Above a color temperature of about 1,700° K, that is, in the range in which natural light sources are prevalent (sunlight, average daylight) and practically all artificial light sources (incandescent lamps, discharge lamps, fluorescent lamps), alarm signals are blocked since both output signals from the amplifier will be in phase opposition. Radiation sources which have color temperatures below about 1,150° K, that is, artificial heat sources such as heat radiation lamps, heat generating apparatus, exhaust pipes from internal combustion engines, and the like, also will not lead to an output signal which might trigger a fire alarm. Monochromatic radiation sources and most radiation sources which do not provide a continuous spectrum of radiation usually do not lead to an output signal from the detection system, since the portion of radiation from such sources in the spectral ranges which are being evaluated by the system of the present invention is usually highly different. In the example of FIG. 3, the factor $k_2$ is negative, and in this special situation, the lower limit will be close to zero.

The system according to the present invention has the advantage with respect to previously proposed flame detection and flame supervision systems and methods that it reacts only to radiation within a narrow temperature range, which is characteristic for flames, and is essentially immune with respect to artificial light sources. Additionally, it is sensitive only to radiation which has the typical changes in intensity, or flicker frequencies, of a flame. The additional possibility presents itself to prevent an output signal if this flicker is strictly cyclical and not random, as in a flame. Detection of a flame can, therefore, be made less subject to extraneous disturbances, and will be practically free from false alarms, or erroneous indication of presence of a flame.

Various changes and modifications may be made, and features described in connection with one of the embodiments may, similarly, be used with the other, within the inventive concept.

I claim:

1. Method to detect presence or absence of a flame in which at least two photo-electric sensors (1, 2) are provided, wherein each one of the sensors is sensitive to a predetermined spectral range of incident light and wherein the respective spectral ranges to which said sensors are sensitive are different;

the sensors providing at least two respective sensed signals, said method comprising evaluating the relative relationship of the a-c components of the respective sensed signals from the sensors (1, 2) representative of presence of light in said spectral ranges and determining if these a-c components fall in a predetermined low-frequency band between two predetermined low frequency limits and, if so, providing a "flame present" signal if, and only if (a) the color temperature of the light incident on the respective sensors is lying between limits defined by said respective different spectral ranges and (b) the flicker of said light within both said limits is within said predetermined low frequency limits.

2. Method according to claim 1, further comprising timing the duration of presence of the "flame present" signal and providing an output signal only if said "flame present" signal persists for a predetermined period of time.

3. Method according to claim 1, wherein the low-frequency band has a range of between 2 and 50 Hertz.

4. Method according to claim 1, wherein the low-frequency band has a range between 5 and 25 Hz.

5. Method according to claim 1, further comprising the step of adjusting the sensitivity of the sensors (1, 2) of different spectral response to supply similar output signals when irradiated by luminescent radiation of a color temperature in the order of about 1,400° K.

6. Method according to claim 1, wherein the step of evaluating the relationship of the signals comprises forming a first difference signal between a first sensed signal and a second sensed signal weighted by a predetermined first factor $k_1$;

forming a second difference signal between the second sensed signal and the first sensed signal weighted by a predetermined second factor $k_2$;

and utilizing that portion of said difference signals which falls within said low-frequency band.

7. Method according to claim 6, wherein the factors $k_1$ and $k_2$ are in the order of about ⅓.

8. Method according to claim 6, wherein the step of evaluating the signals further comprises analyzing the relative phase of the first and second difference signals and providing said "flame present" signal only if the phase of the first and of the second difference signals is about the same.

9. Method according to claim 6, wherein two sensors are provided, one sensor having a peak sensitivity in one spectral range (R) and the other sensor having a peak sensitivity in another spectral range (B);

and wherein the step of forming said first difference signal comprises forming a signal defined by the relationship $$V_1 = g_1 (R - k_1 B);$$

the step of forming the second difference signal comprises forming a signal defining the relationship:

$$V_2 = g_2 (B - k_2 R),$$

wherein $g_1$ and $g_2$ are predetermined proportionality factors; and R and B are the signals from the respective sensors.

10. Method according to claim 9, further comprising the step of adjusting the sensitivity of the sensors of the different spectral response to supply equal output signals when irradiated by luminescent radiation of a predetermined color temperature;

and wherein one of the sensors is adjusted to have a color temperature vs. output signal characteristic which is changing at a lesser rate than the change of output signal with respect to color temperature of the other sensor in the ranges at both sides of said predetermined color temperature.

11. System to detect presence or absence of flames having at least two photo-sensitive sensors (1, 2) providing sensed output signals (R, B) comprising frequency selection means (5, 6) connected to said sensors and passing a-c signal components from said sensors within a low-frequency range lying between two predetermined limits, a difference amplifier means (4) having the sensed signals applied thereto and forming a first difference signal defined by $$V_1 = g_1 (R - k_1 B),$$

and a second difference signal defined by $$V_2 = g_2 (B - k_2 R)$$

wherein $g_1$ and $g_2$ are proportionality factors determined by the circuit components of the difference amplifier means; R and B are the output signals from the respective sensors;

and $k_1$ and $k_2$ are other proportionality factors determined by the relative circuit components of the difference amplifier means:

and a phase comparator (7) having the first and second difference signals applied thereto and comparing the phase relationship between said signals and providing a "flame present " signal when said first and second difference signals have the same relative phase position.

12. System according to claim 11, wherein the difference amplifier means (4) comprises two transistors (20, 21) having their bases controlled by the photoelectric sensors, and having, each, an individual separate resistor ($r_1$, $r_2$) connected in the emitter-collector path and a common resistor ($r_0$) in the emitter-collector paths of the transistors.

13. System according to claim 11, wherein the phase comparator (7) comprises a voltage doubler circuit including a capacitor (33) and a diode (32) connected to one output of the difference amplifier means, and a transistor, controlled from the other output of the difference amplifier means, one output providing one of said difference signals and the other output providing the other of said difference signals.

14. System according to claim 13, wherein the diode (32) and the transistor (30) of the phase comparator (7) are so poled, and connected, relative to each other, that a signal will build up on the capacitor (33) of the voltage doubler circuit only if the two first and second difference signals derived from the difference amplifier means (4) have the same relative phase.

15. System according to claim 11, further including a timing circuit (12) connected to the output of the phase comparator (7) and passing the output signal therefrom only if the output signal from the phase comparator persists for a predetermined period of time.

16. System according to claim 11, further comprising a temperature-sensitive, temperature-compensating component (51) in circuit with at least one of the photo-electric sensors.

17. System according to claim 16, wherein the temperature sensitive component comprises a negative temperature coefficient resistor (51) connected in series with the photoelectric sensor.

18. System according to claim 12, wherein the transistors (20, 21) have, each, a separate base resistor of resistance $r_1$ and $r_2$, respectively, connected to a common junction, and a common resistor having a resistance of $r_0$, connecting the common junction to a source of power supply, wherein the relative values of the resistances determine said factors $k_1$, $k_2$ in accordance with relationships (3) and (4) as aforesaid.

19. System according to claim 18, wherein each of said transistors has its collector connected in an amplifier circuit and the gain of amplication of each amplifier circuit is matched to the spectral response of each of the sensors such that at a predetermined color temperature of radiation, the difference signals will be equal, and change of difference signals upon change of said color temperature of irradiation of the sensors has opposite effect on the difference signals from said transistors.

20. System according to claim 19, wherein said predetermined color temperature is about 1,400°K.

* * * * *